US010120309B2

(12) United States Patent
Ebe

(10) Patent No.: US 10,120,309 B2
(45) Date of Patent: Nov. 6, 2018

(54) FIXING DEVICE, IMAGE FORMING APPARATUS, AND BELT-SHAPE CHANGING METHOD

(71) Applicant: Konica Minolta, Inc., Chiyoda-ku, Tokyo (JP)

(72) Inventor: Asahi Ebe, Tokyo (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 15/668,928

(22) Filed: Aug. 4, 2017

(65) Prior Publication Data

US 2018/0046120 A1 Feb. 15, 2018

(30) Foreign Application Priority Data

Aug. 10, 2016 (JP) ..... 2016-157964

(51) Int. Cl.
*G03G 15/20* (2006.01)

(52) U.S. Cl.
CPC ..... *G03G 15/2053* (2013.01); *G03G 15/2028* (2013.01)

(58) Field of Classification Search
CPC ..... G03G 15/2028; G03G 15/2053; G03G 15/2064; G03G 15/2085; G03G 15/5029
USPC ..... 399/45, 67, 329
See application file for complete search history.

(56) References Cited

U.S. PATENT DOCUMENTS

2009/0208262 A1* 8/2009 Osada ..... G03G 15/2064 399/329
2013/0215204 A1* 8/2013 Inoue ..... B41F 21/10 347/104
2016/0170337 A1* 6/2016 Onishi ..... G03G 15/1615 399/121
2016/0170340 A1* 6/2016 Wazumi ..... G03G 15/2064 399/67
2016/0378031 A1* 12/2016 Takahashi ..... G03G 15/2053 399/67

FOREIGN PATENT DOCUMENTS

JP 2014-202901 A 10/2014

* cited by examiner

*Primary Examiner* — Sophia S Chen
(74) *Attorney, Agent, or Firm* — Buchanan Ingersoll & Rooney PC

(57) ABSTRACT

A fixing device includes a first pressing member, a fixing belt, a second pressing member, a tensioning section on which the fixing belt is wound on an upstream side relative to the fixing nip in a rotation direction of the fixing belt and which is configured to impart tension to the fixing belt, and a control section configured to control the tensioning section such that the shape in an axial direction of the fixing belt is changed in accordance with a type of sheet which passes through the fixing nip.

16 Claims, 15 Drawing Sheets

FIXING DEVICE, IMAGE FORMING APPARATUS, AND BELT-SHAPE CHANGING METHOD

CROSS REFERENCE TO RELATED APPLICATIONS

The entire disclosure of Japanese Patent Application No. 2016-157964, filed on Aug. 10, 2016, including description, claims, drawings and abstract are incorporated herein by reference in its entirety.

BACKGROUND OF THE INVENTION

1. Field of the Invention

The present invention relates to a fixing device, an image forming apparatus, and a belt-shape changing method.

2. Description of Related Art

An image forming apparatus utilizing electrophotographic process technology (printers, copiers, fax machines, etc.) typically forms an electrostatic latent image by irradiating a charged photoconductor drum (image bearing member) with laser beams (exposure) based on image data. The latent image is then visualized to form a toner image by supplying a toner from a developing device to the photoconductor drum where the latent image has been formed. Further, the toner image is transferred to a sheet directly or indirectly, and subsequently fixed through heating and pressing at a fixing nip to form a toner image on the sheet.

A fixing device used for such an image forming apparatus includes a fixing roller, on which a fixing belt is wound, and a pressure roller configured to press the fixing roller via the fixing belt and to form a fixing nip between the pressure roller and the fixing belt.

During the conveyance of a sheet in a fixing device, wavy wrinkles along the conveying direction of the sheet arise in a portion of the sheet that has passed through a fixing nip when force is generated to displace the sheet in a direction toward the central portion from the both end portions of the sheet.

Japanese Patent Application Laid-Open No. 2014-202901, for example, discloses a configuration including a tension roller for imparting tension to a fixing belt. This technique suppresses the occurrence of wavy wrinkles of sheets by imparting tension to the fixing belt by the tension roller.

In some cases, the shape of the tension roller is a reverse crown shape, which has a smaller diameter toward the central portion from the both end portions in the axial direction. Such a tension roller having a reverse crown shape can increase tension further in both end portions of a fixing belt than in the central portion, and thus the both end portions in the axial direction become pulled in the opposite side to the conveying direction at the fixing nip.

Under such a state, the both end portions in the axial direction of the fixing belt become further suspended, relative to the central portion, resulting in a larger area in the central portion of the fixing nip than that in the both end portions. Since greater force is exerted on the central portion in the axial direction of a sheet than on the both end portions of the sheet, force for extending from the central portion in the axial direction to the both end portions can be generated in a portion of the sheet that has passed through the fixing nip, thereby achieving good quality of the sheet in terms of wavy wrinkles.

SUMMARY OF THE INVENTION

In a sheet feeding portion of a fixing belt, which is a contact portion with a sheet, when the greater force is exerted on the central portion in the width direction of the sheet than on the both end portions, the fixing belt is displaced on a side of the central portion of the fixing belt. This causes a problem in which wrinkles arise in the central portion of the fixing belt (hereinafter referred to as "belt wrinkles").

The configuration described in Japanese Patent Application Laid-Open No. 2014-202901 takes countermeasures against wrinkles arising in a sheet feeding portion as well as in a sheet non-feeding portion (which is a non-contact portion with a sheet) of a fixing belt. The configuration, however, does not take any countermeasures against belt wrinkles, and thus has certain limits on suppressing the occurrence of both wavy wrinkles of a sheet and belt wrinkles of a fixing belt.

An object of the present invention is to provide a fixing device which can suppress the occurrence of both wavy wrinkles of a sheet and belt wrinkles of a fixing belt, as well as an image forming apparatus and a belt-shape changing method.

To achieve at least one of the abovementioned objects, a fixing device reflecting one aspect of the present invention includes: a first pressing member; a rotatable endless fixing belt which is wound on the first pressing member; a second pressing member configured to press the first pressing member via the fixing belt and to form a fixing nip between the second pressing member and the fixing belt; a tensioning section on which the fixing belt is wound on an upstream side relative to the fixing nip in a rotation direction of the fixing belt, and which is configured to impart tension to the fixing belt; and a control section configured to control the tensioning section such that a shape in an axial direction of the fixing belt is changed in accordance with a type of sheet which passes through the fixing nip.

In the abovementioned fixing device, the control section preferably changes the shape in the axial direction of the fixing belt such that the amount of reverse crown of the tensioning section varies.

In the abovementioned fixing device, the control section preferably changes the shape in the axial direction of the fixing belt such that both end portions in the axial direction are further apart, relative to a central portion in the axial direction, from a center line which passes through a center of the fixing nip in a conveying direction of the sheet.

In the abovementioned fixing device, the tensioning section preferably includes an elastically deformable contact portion which extends in the axial direction and which comes into contact with the fixing belt; and the control section preferably performs a control action, in accordance with the type of sheet, such that the contact portion is elastically deformed so as to be positioned on a side of the fixing nip as the contact portion extends from both end portions toward a central portion in the axial direction.

In the abovementioned fixing device, the tensioning section preferably includes two contact members which are provided aligning in both sides of the central portion in the axial direction of the fixing belt and which extend toward a side of the end portions in the axial direction from the central portion in the axial direction of the fixing belt, and a supporting member configured to turnably support the contact members with a central portion in the axial direction as a pivot; and the control section preferably performs a control action, in accordance with the type of sheet, such that the contact members are turned so that the central portion in the axial direction of the contact members is positioned on a side of the fixing nip, relative to the both end portions in the axial direction.

In the abovementioned fixing device, the tensioning section preferably includes a rotatable cylindrical body portion which extends in the axial direction, a first contact portion which protrudes from the body portion and has a larger amount of protrusion toward the both end portions in the axial direction from the central portion in the axial direction, and a second contact portion which protrudes from the body portion at a position different from the first contact portion, which has a larger amount of protrusion toward the both end portions in the axial direction from the central portion in the axial direction, and which has a smaller amount of protrusion than that in the axial direction of the first contact portion; the tensioning section is preferably contactable with the fixing belt via any of the first contact portion the second contact portion, and the body portion at a position different from the first contact portion and the second contact portion; and the control section preferably controls, in accordance with the type of sheet, the tensioning section such that any of the first contact portion, the second contact portion, and the body portion at a position different from the first contact portion and the second contact portion comes into contact with the fixing belt.

In the abovementioned fixing device, the tensioning section preferably includes at least three roller members which are provided aligning in the axial direction and which come into contact with the fixing belt; the roller members are configured to be movable such that a contact position with the fixing belt and a distance to the fixing nip are changed; and the control section controls, in accordance with the type of sheet, the tensioning section such that the roller member which is positioned at a position corresponding to the central portion in the axial direction of the fixing belt is positioned on a side of the fixing nip, relative to the roller members which are positioned at positions corresponding to the both end portions in the axial direction.

In the abovementioned fixing device, the tensioning section preferably includes a first roller which linearly extends in the axial direction, a second roller having a larger diameter toward a central portion from both end portions in the axial direction, and a third roller having a larger diameter toward a central portion from both end portions in the axial direction, and having a larger absolute difference value between a diameter of the central portion in the axial direction and a diameter of the both end portions in the axial direction than that of the second roller; and the control section preferably controls, in accordance with the type of sheet, the tensioning section such that any of the first roller, the second roller, and the third roller comes into contact with the fixing belt.

In the abovementioned fixing device, the tensioning section preferably includes a cylindrical small-diameter roller, a pair of large-diameter rollers which are configured in a hollow cylindrical shape to be capable of covering the small-diameter roller, and are movable in the axial direction; and the control section preferably controls, in accordance with the type of sheet, changing of the amount of movement in the axial direction of the large-diameter rollers.

In the abovementioned fixing device, the tensioning section preferably includes a hollow cylindrical metal roller, an elastic section which covers the metal roller, and a heating section disposed inside the metal roller; and the control section preferably controls, in accordance with the type of sheet, the heating section such that a temperature in the axial direction of the heating section is changed.

In the abovementioned fixing device, a thickness of the elastic section is preferably larger in both end portions in the axial direction than in a central portion in the axial direction.

To achieve at least one of the abovementioned objects, an image forming apparatus reflecting one aspect of the present invention includes: a first pressing member; a rotatable endless fixing belt which is wound on the first pressing member; a second pressing member configured to press the first pressing member via the fixing belt and to form a fixing nip between the second pressing member and the fixing belt; a tensioning section on which the fixing belt is wound on an upstream side relative to the fixing nip in a rotation direction of the fixing belt, and which is configured to impart tension to the fixing belt; and a control section configured to control the tensioning section such that a shape in an axial direction of the fixing belt is changed in accordance with the type of sheet which passes through the fixing nip.

To achieve at least one of the abovementioned objects, a belt-shape changing method reflecting one aspect of the present invention is a belt-shape changing method in a fixing device which includes a first pressing member, a rotatable endless fixing belt wound on the first pressing member, a second pressing member configured to press the first pressing member via the fixing belt and to form a fixing nip between the second pressing member and the fixing belt, and a tensioning section on which the fixing belt is wound on an upstream side relative to the fixing nip in a rotation direction of the fixing belt and which is configured to impart tension to the fixing belt, and the method includes: controlling the tensioning section such that a shape in an axial direction of the fixing belt is changed in accordance with a type of sheet which passes through the fixing nip.

DESCRIPTION OF THE PREFERRED EMBODIMENTS

Figure 1:
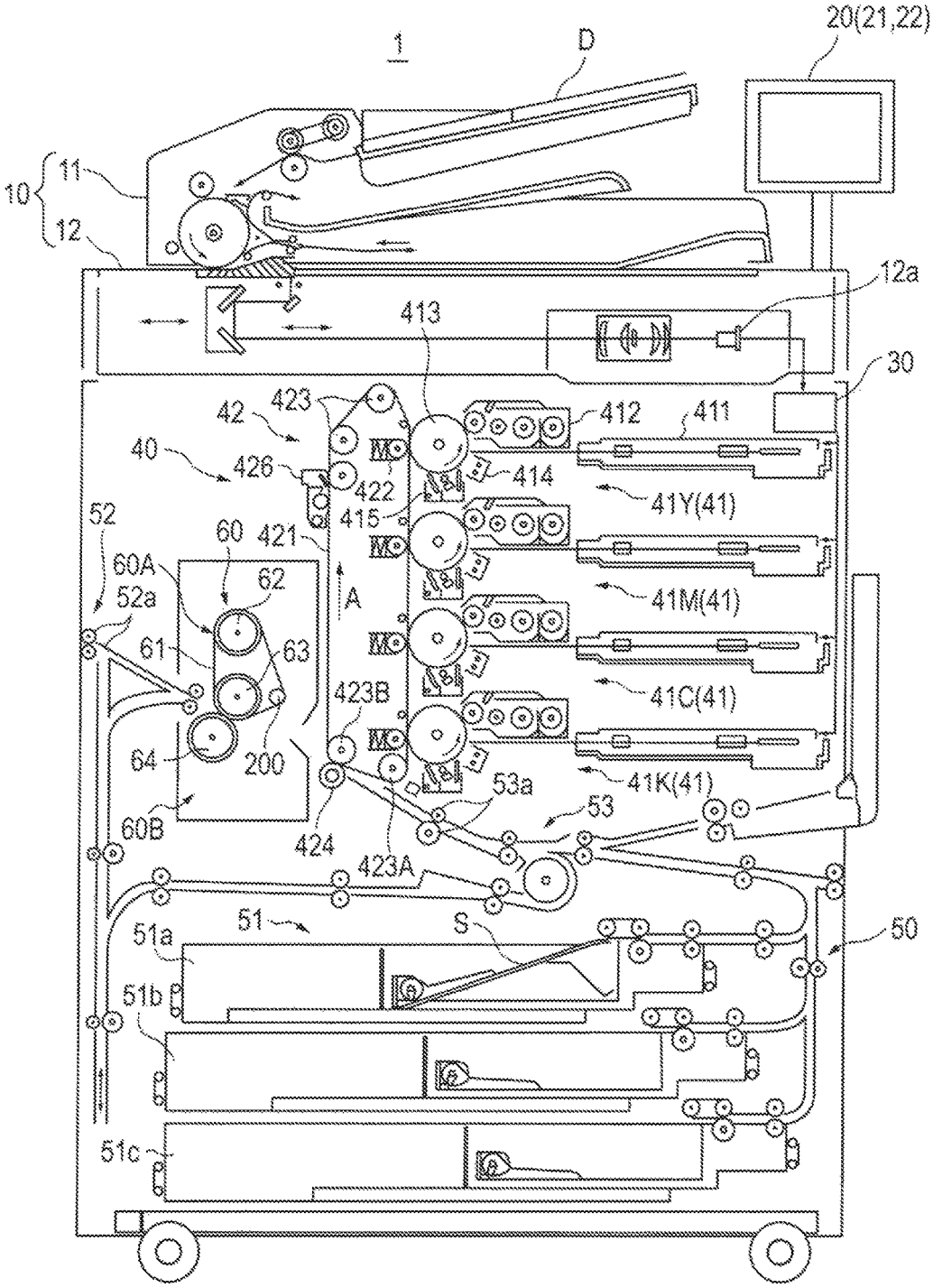
FIG. 1 schematically illustrates the entire configuration of an image forming apparatus according to an embodiment.
Figure 2:
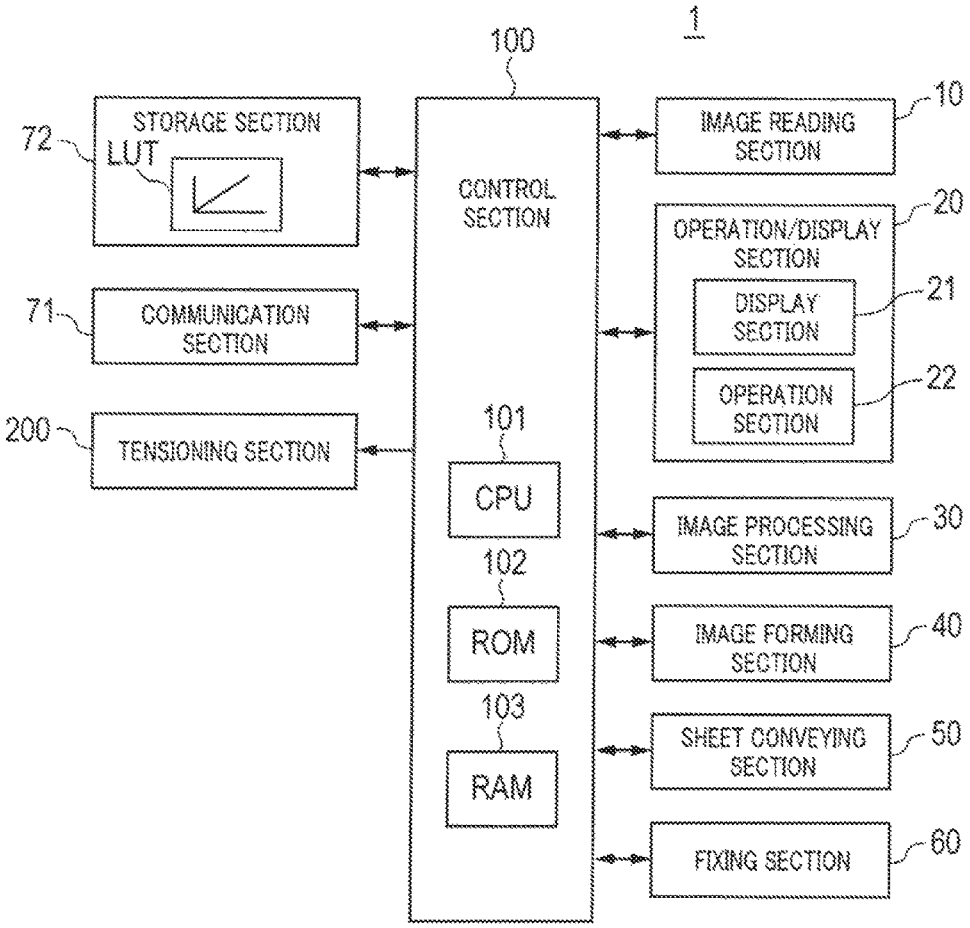
FIG. 2 illustrates a main section of a control system of the image forming apparatus according to the embodiment.

In the following, the present embodiment will be described in detail with reference to the drawings. FIG. 1 schematically illustrates the entire configuration of image forming apparatus 1 according to the embodiment. FIG. 2 illustrates a main section of a control system of image forming apparatus 1 according to the embodiment.

Image forming apparatus 1 illustrated in FIGS. 1 and 2 is an intermediate transfer-type color image forming apparatus utilizing electrophotographic process technology. Image forming apparatus 1 transfers each color toner image of yellow (Y), magenta (M), cyan (C), and black (K) formed on photoconductor drum 413 to intermediate transfer belt 421 (primary transfer) to superimpose the four color toner images on intermediate transfer belt 421, and then transfers them to sheet S to form an image (secondary transfer).

Image forming apparatus 1 employs a tandem mode in which photoconductor drums 413 corresponding to YMCK four colors are arranged in series along the running direction of intermediate transfer belt 421, and each color toner image is successively transferred to intermediate transfer belt 421 in a single procedure.

Image forming apparatus 1 includes image reading section 10, operation/display section 20, image processing section 30, image forming section 40, sheet conveying section 50, fixing section 60, and control section 100. Fixing section 60 corresponds to "a fixing device" of the present invention.

Control section 100 includes central processing unit (CPU) 101, read-only memory (ROM) 102, random-access memory (RAM) 103, and/or the like. CPU 101 reads a program corresponding to processing details from ROM 102, loads the program into RAM 103, and performs, cooperatively with the loaded program, centralized control of the operations in respective blocks of image forming apparatus 1. During this step, various data stored in storage section 72 are referred to. Storage section 72 is composed of, for example, a nonvolatile semiconductor memory (so-called flash memory) and/or a hard disk drive.

Control section 100 transmits and receives various data to and from an external apparatus (personal computer, for example) connected to a communication network, such as a local area network (LAN) or a wide area network (WAN), via communication section 71. Control section 100, for example, receives image data (input image data) transmitted from an external apparatus, and operates to form an image on sheet S, based on the image data. Communication section 71 is composed of, for example, a network interface card, such as a LAN adapter.

Image reading section 10 includes auto document feeder (ADF) 11, and document image scanner 12, for example.

Auto document feeder 11 conveys, with a conveyance mechanism, documents D placed on a document tray and sends them to document image scanner 12. Auto document feeder 11 can continuously and simultaneously read images of many documents D (including both-side ones) placed on a document tray.

Document image scanner 12 optically scans documents conveyed from auto document feeder 11 onto a contact glass or documents placed on a contract glass, and images reflected light from the documents on a light receiving surface of charge coupled device (CCD) sensor 12*a* to read document images. Image reading section 10 generates input image data based on results read by document image scanner 12. The input image data undergo predetermined image processing in image processing section 30.

Operation/display section 20 is composed of, for example, a touch panel-type liquid crystal display (LCD), and functions as both display section 21 and operation section 22. Display section 21 displays various operation screens, image conditions, operation conditions of each function, and/or the like, in accordance with display control signals input from control section 100. Operation section 22 equipped with various operation keys, such as a numeric keypad and a start key, receives various input operations by users and outputs operation signals to control section 100.

Image processing section 30 includes a circuit and/or the like that performs digital image processing of input image data in accordance with default settings or user settings. For example, image processing section 30 performs tone correction based on tone correction data (tone correction table) under the control of control section 100. Moreover, image processing section 30 performs various correction processing, such as color correction or shading correction, in addition to tone correction, compression processing, and/or the like of input image data. Image forming section 40 is controlled, based on the image data thus processed.

Image forming section 40 includes, for example, intermediate transfer unit 42 and image forming units 41Y, 41M, 41C, and 41K for forming images of color toners of Y component, M component, C component, and K component, based on input image data.

Image forming units 41Y, 41M, 41C, and 41K for Y component, M component, C component, and K component have similar configurations. For convenience in illustration and description, common components are denoted by the same numerals and such numerals are accompanied by Y, M, C, or K when they are distinguished. In FIG. 1, only components of image forming unit 41Y for Y component are denoted by numerals, and numerals are omitted for components of other image forming units 41M, 41C, and 41K.

Image forming unit 41 includes exposing device 411, developing device 412, photoconductor drum 413, charging device 414, drum cleaning device 415, and/or the like.

Photoconductor drum 413 is, for example, a negative-charging organic photoconductor (OPC) formed by successively laminating an undercoat layer (UCL), a charge generation layer (CGL), and a charge transport layer (CTL) on a peripheral surface of an aluminum conductive hollow cylinder (aluminum tube).

Charging device 414 evenly and negatively charges the surface of photoconductor drum 413 by generating corona discharge.

Exposing device 411 is configured as a semiconductor laser, for example, and irradiates photoconductor drum 413 with laser beams corresponding to images of respective color components. Thus, positive charges are generated in the charge generation layer of photoconductor drum 413, and transported to the surface of the charge transport layer, thereby neutralizing surface charges (negative charges) of photoconductor drum 413. As a result, electrostatic latent images of respective color components are formed on the surface of photoconductor drum 413 due to potential differences from the surroundings.

Developing device 412 is a developing device of a two-component developing system, and forms a toner image by attaching toners of respective color components to the surface of photoconductor drum 413 to visualize electrostatic latent images. Developing device 412 forms a toner image on a surface of photoconductor drum 413 by supplying a toner contained in a developer to photoconductor drum 413.

Drum cleaning device 415 includes a drum cleaning blade or the like to be slid on the surface of photoconductor drum 413, and removes transfer residual toner remaining on the surface of photoconductor drum 413 after primary transfer.

Intermediate transfer unit 42 includes intermediate transfer belt 421, primary transfer roller 422, a plurality of support rollers 423, secondary transfer roller 424, and belt cleaning device 426, for example.

Intermediate transfer belt 421 is composed of an endless belt, and looped around a plurality of support rollers 423 under tension. At least one of a plurality of support rollers 423 is composed of a driving roller, and the rest are composed of driven rollers, intermediate transfer belt 421 runs in direction A at a constant speed by rotation of a driving roller. Intermediate transfer belt 421 is an electrically conductive elastic belt and rotated/driven by control signals from control section 100.

Primary transfer roller 422 is disposed facing photoconductor drum 413 of each color component on the side of the inner peripheral surface of intermediate transfer belt 421. A primary transfer nip, for transferring a toner image to intermediate transfer belt 421 from photoconductor drum 413, is formed by firmly pressing primary transfer roller 422 against photoconductor drum 413 via intermediate transfer belt 421.

Secondary transfer roller 424 is disposed facing backup roller 423B, which is disposed on the downstream side of driving roller 423A in the running direction of the belt, on the side of the outer peripheral surface of intermediate transfer belt 421. A secondary nip, for transferring a toner image to sheet S from intermediate transfer belt 421, is formed by firmly pressing backup roller 423B against secondary transfer roller 424 through intermediate transfer belt 421.

Belt cleaning device 426 removes transfer residual toner remaining on the surface of intermediate transfer belt 421 after secondary transfer.

When intermediate transfer belt 421 passes through the primary transfer nip, toner images on photoconductor drum 413 are successively superimposed and transferred (primary transfer). Specifically, primary transfer bias is applied to primary transfer roller 422 to impart charges of the opposite polarity (to toners) to the rear surface side of intermediate transfer belt 421 (contact side with primary transfer roller 422), thereby electrostatically transferring toner images to intermediate transfer belt 421.

After that, when sheet S passes through the secondary transfer nip, toner images on intermediate transfer belt 421 are transferred to sheet S (secondary transfer). Specifically, secondary transfer bias is applied to backup roller 423B to impart charges of the same polarity (as toners) to the front surface side of sheet S (contact side with intermediate transfer roller 421), thereby electrostatically transferring toner images to sheet S.

Fixing section 60 includes upper-side fixing section 60A, which contains a fixing surface-side member disposed on the fixing surface side of sheet S (toner image-formed surface), and lower-side fixing section 60B, which contains a rear surface-side supporting member disposed on the rear surface side of sheet S (opposite surface to the fixing surface), for example. A fixing nip, for pinching and conveying sheet 5, is formed by firmly pressing the rear surface-side supporting member against the fixing surface-side member.

Fixing section 60 heats and presses conveyed sheet S in which toner images have been transferred (secondary transfer), thereby fixing toner images on sheet S.

Upper-side fixing section 60A includes endless fixing belt 61 as the fixing surface-side member, heating roller 62, fixing roller 63, and tensioning section 200. Fixing belt 61 is supported under tension by heating roller 62, fixing roller 63, and tensioning section 200. Fixing roller 63 corresponds to "a first pressing member" of the present invention. Tensioning section 200 will be described hereinafter.

Lower-side fixing section 60B includes pressure roller 64 as the rear surface-side supporting member. Pressure roller 64 forms a fixing nip with fixing belt 61 for pinching and conveying sheets S. Pressure roller 64 corresponds to "a second pressing member" of the present invention.

Sheet conveying section 50 includes sheet feeding section 51, sheet ejection section 52, conveying path section 53, and/or the like. Three sheet feeding tray units 51*a* to 51*c*, which constitute sheet feeding section 51, store sheets S classified based on basis weight, size, or the like (standard paper, special paper) in accordance with predetermined types.

Conveying path section 53 includes a plurality of conveying roller pairs, such as registration roller pairs 53*a*. Sheets S stored in sheet feeding tray units 51*a* to 51*c* are each sent out from the topmost portion and conveyed to image forming section 40 through conveying path section 53. During this step, a registration roller section, where registration roller pairs 53*a* are disposed, corrects the tilt of sheets S and adjusts the timing of conveyance. Then, toner images on intermediate transfer belt 421 are simultaneously transferred to the one-side surface of sheet S in image forming section 40 (secondary transfer), and a fixing step is performed in fixing section 60. Sheets S bearing formed images are ejected outside the apparatus by sheet ejection section 52 equipped with sheet ejection rollers 52*a*.

In the following, tensioning section 200 will be described. Tensioning section 200, on which fixing belt 61 is wound on the upstream side relative to a fixing nip in the rotation direction of fixing belt 61, guides fixing belt 61 toward the fixing nip. Tensioning section 200 imparts tension to fixing belt 61 by pulling fixing belt 61 toward the upstream side relative to the fixing nip.

Figure 3A:
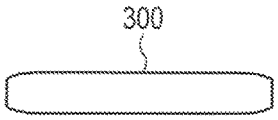
FIG. 3A illustrates a linear roller member.
Figure 3B:
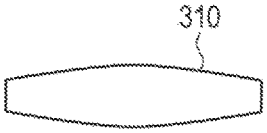
FIG. 3B illustrates a crown roller member.
Figure 3C:
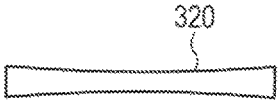
FIG. 3C illustrates a reverse crown roller member.
Figure 4A:
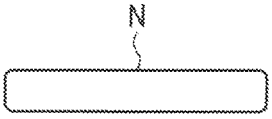
FIG. 4A illustrates the shape of a fixing nip when a tensioning section is a linear roller member.
Figure 4B:
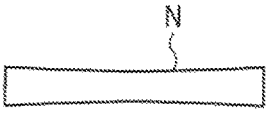
FIG. 4B illustrates the shape of a fixing nip when a tensioning section is a crown roller member.
Figure 4C:
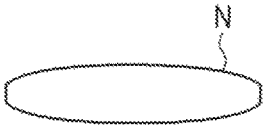
FIG. 4C illustrates the shape of a fixing nip when a tensioning section is a reverse crown roller member.

As tensioning members to impart tension to fixing belt 61, roller-type members are typically known. FIG. 3A illustrates linear roller member 300, FIG. 3B illustrates crown roller member 310, and FIG. 3C illustrates reverse crown roller member 320. FIG. 4A illustrates the shape of fixing nip N when the tensioning section is linear roller member 300, FIG. 4B illustrates the shape of fixing nip N when the tensioning section is crown roller member 310, and FIG. 4C illustrates the shape of fixing nip N when the tensioning section is reverse crown roller member 320.

As illustrated in FIGS. 3A, 3B, and 3C, examples of the roller-type members include linear roller member 300 (see FIG. 3A), crown roller member 310 (see FIG. 3B), and reverse crown roller member 320 (see FIG. 3C).

Linear roller member 300 is a linear-shaped roller member that extends in the axial direction, which is the horizontal direction as illustrated (hereinafter simply referred to as "the axial direction"). Crown roller member 310 is a crown-shaped roller member that has a smaller diameter toward the both end portions from the central portion in the axial direction. Reverse crown roller member 320 is a reverse crown-shaped roller member that has a smaller diameter toward the central portion from the both end portions in the axial direction.

Linear roller member 300, crown roller member 310, and reverse crown roller member 320 are different in manners to impart tension to fixing belt 61, resulting in different shapes of fixing nip N.

Linear roller member 300 imparts tension to fixing belt 61 evenly in the axial direction, resulting in a rectangular shape of fixing nip N, as illustrated in FIG. 4A.

Crown roller member 310 imparts greater tension to the both end portions than to the central portion in the axial direction of fixing belt 61, and consequently the central portion in the axial direction of fixing belt 61 is further suspended at the fixing nip N, relative to the both end portions. Accordingly, fixing nip N has a narrower shape in the central portion than in the both end portions in the axial direction, as illustrated in FIG. 4B.

Reverse crown roller member 320 imparts greater tension to the both end portions in the axial direction of fixing belt 61 than to the central portion, and consequently the both end portions in the axial direction of fixing belt 61 are slightly suspended, relative to the central portion. Accordingly, fixing nip N has a narrower shape in the both end portions than in the central portion in the axial direction, as illustrated in FIG. 4C.

Meanwhile, wavy wrinkles arise along the conveying direction of sheet S when force is generated in a portion of sheet S that has passed through fixing nip N to displace sheet S toward a side of the central portion in the axial direction. Such wavy wrinkles can be suppressed by imparting tension to fixing belt 61 by tensioning section 200. When the shape of tensioning section 200 is changed, however, the shape of fixing nip N varies, and consequently the quality in terms of wavy wrinkles varies in accordance with the shape of tensioning section 200.

Figure 5A:
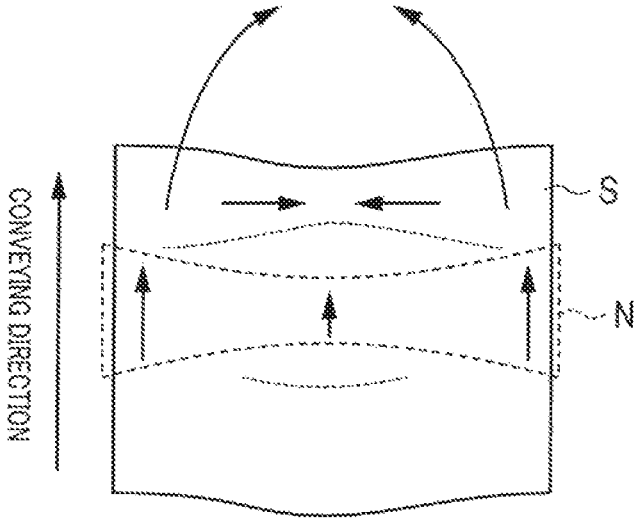
FIG. 5A illustrates a state of conveyance of a sheet at a fixing nip when a tensioning section is a crown roller member.
Figure 5B:
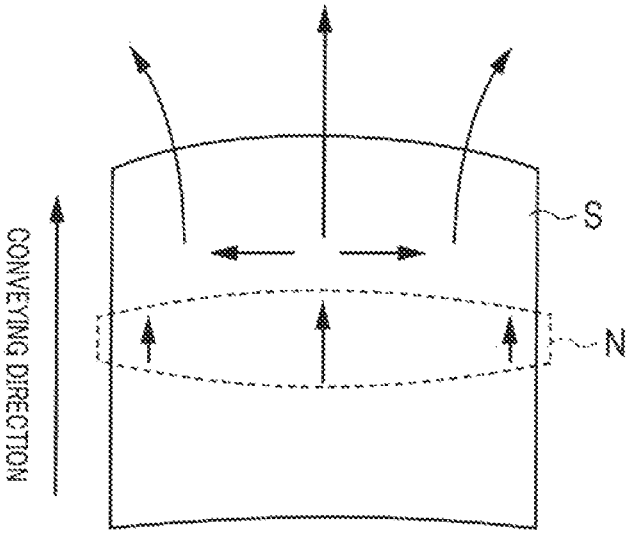
FIG. 5B illustrates a state of conveyance of a sheet at a fixing nip when a tensioning section is a reverse crown roller member.

FIG. 5A illustrates a state of conveyance of sheet S at fixing nip N when tensioning section 200 is crown roller member 310, whereas FIG. 5B illustrates a state of conveyance of sheet S at fixing nip N when tensioning section 200 is reverse crown roller member 320.

For example, when the shape of tensioning section 200 is a shape like crown roller member 310 of FIG. 3B, the shape of fixing nip N is narrower in the central portion than in the both end portions in the axial direction, as illustrated in FIG. 5A. Consequently, a contact area with sheet S within fixing nip N is larger in the both end portions than in the central portion, exerting greater force on sheet S in the both end portions than in the central portion. This generates force a the portion of sheet S that has passed through fixing nip N to displace sheet S toward the central portion from the both end portions in the axial direction, and thus the occurrence of wavy wrinkles of sheet S is highly probable.

In contrast, when the shape of tensioning section 200 is a shape like reverse crown roller member 320 of FIG. 3C, the shape of fixing nip N is narrower in the both end portions than in the central portion in the axial direction, as illustrated in FIG. 5B. Accordingly, a contact area with sheet S within fixing nip N is larger in the central portion than in the both end portions, exerting greater force on sheet S in the central portion than in the both end portions. This generates force in a portion of sheet S that has passed through fixing nip N to extend from the central portion to the both end portions in the axial direction. This suppresses wavy wrinkles of sheet S. Therefore, in order to suppress wavy wrinkles of sheet S, the shape of tensioning section 200 is preferably a shape like reverse crown roller member 320.

Figure 6A:
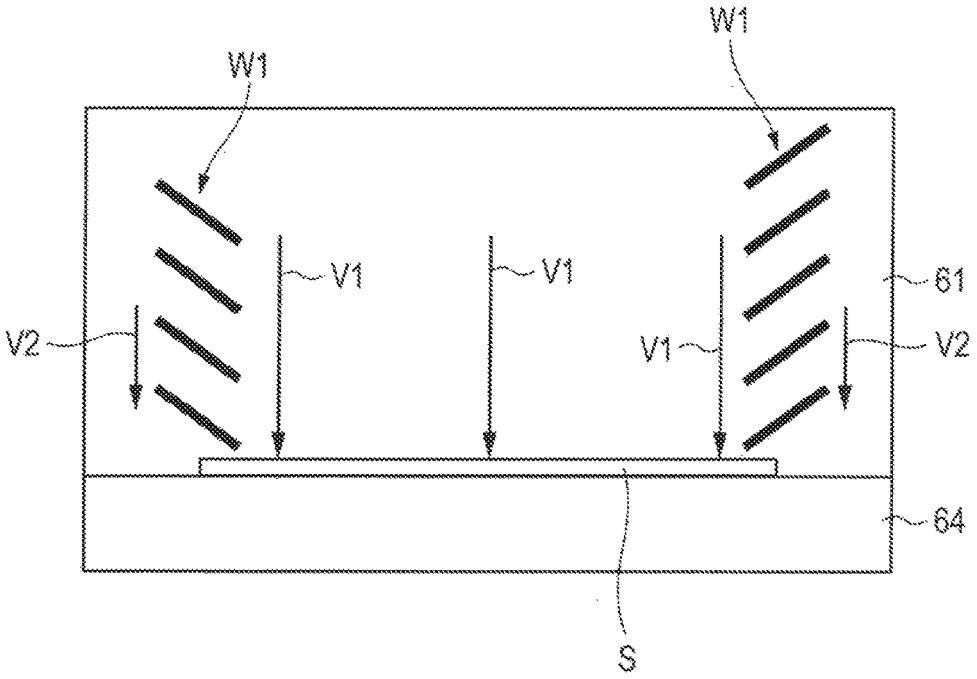
FIG. 6A illustrates a state in which rib-like wrinkles arise on a fixing belt.
Figure 6B:
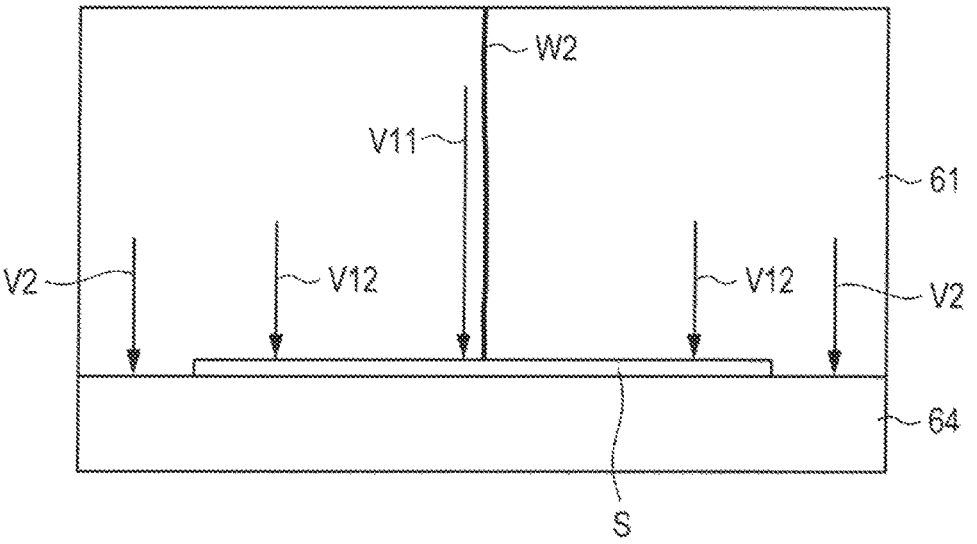
FIG. 6B illustrates a state in which belt wrinkles arise on a fixing belt.

FIG. 6A illustrates a state in which rib-like wrinkles W1 arise on fixing belt 61, and FIG. 6B illustrates a state in which belt wrinkles W2 arise on fixing belt 61.

As illustrated in FIG. 6A, fixing belt 61 tends to cause a difference in speed between a sheet feeding portion and a sheet non-feeding portion in the width direction of sheet S when sheet S with a large basis weight, such as cardboard, is fed. This is because a portion of fixing roller 63 corresponding to the sheet feeding portion is depressed (when cardboard is fed) by the thickness of cardboard via fixing belt 61, and thus fixing roller 63 has a smaller outer diameter corresponding to the sheet feeding portion than an outer diameter corresponding to the sheet non-feeding portion. This results in faster conveying speed V1 in the sheet feeding portion than conveying speed V2 in the sheet non-feeding portion, generating wrinkles W1 (hereinafter referred to as "rib-like wrinkles") at the boundary between the sheet feeding portion and the sheet non-feeding portion of fixing belt 61.

Such rib-like wrinkles W1 can be suppressed by imparting proper tension to fixing belt 61 and stretching fixing belt 61 by tensioning section 200. When tensioning section 200 is shaped like reverse crown roller member 320 to deal with wavy wrinkles of sheet S, however, force V11 exerted on the central portion in the axial direction at fixing nip N becomes greater than force V12 exerted on the both end portions, as illustrated in FIG. 6B. This results in displacement of fixing belt 61 toward the central portion due to conveyed sheets S, and thus wrinkles W2 (hereinafter referred to as "belt wrinkles") arise.

As for belt wrinkles W2, a larger amount of reverse crown of reverse crown roller member 320 leads to a greater pulling force in the both end portions than in the central portion of fixing belt 61. This results in a greater force for displacement toward the central portion in the axial direction of fixing belt 61, and thus belt wrinkles W2 arise readily. Belt wrinkles W2 arising on fixing belt 61 adversely affect image forming regions of sheets S.

Figure 7A:
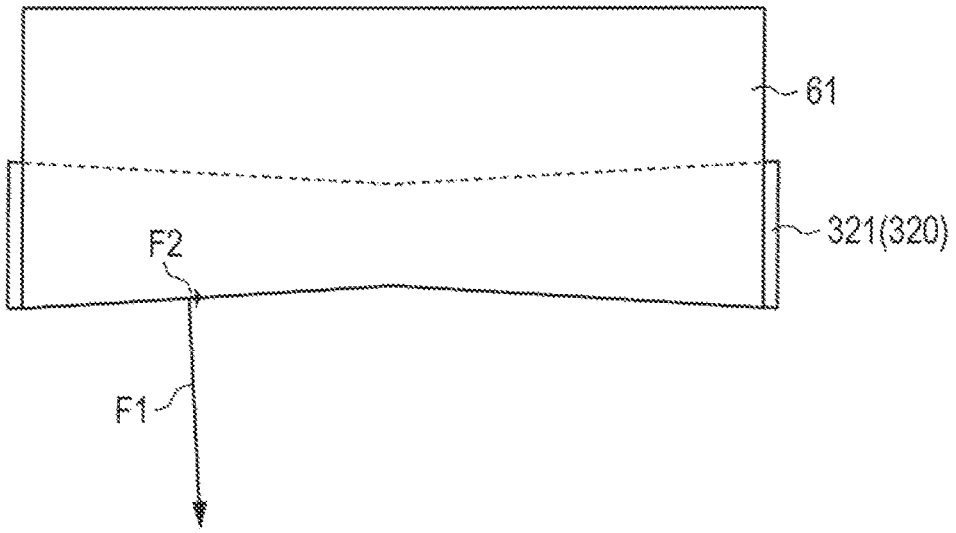
FIG. 7A illustrates a fixing belt wound on a reverse crown roller member having a relatively small amount of reverse crown.

Meanwhile, the amount of reverse crown of reverse crown roller member 320 herein refers to an absolute difference value in a distance between the position of the both end portions in the axial direction and the position of the central portion in the axial direction of reverse crown roller member 320. FIG. 7A illustrates fixing belt 61 wound on reverse crown roller member 321 having a relatively small amount of reverse crown, whereas FIG. 7B illustrates fixing belt 61 wound on reverse crown roller member 322 having a relatively large amount of reverse crown.

Figure 7B:
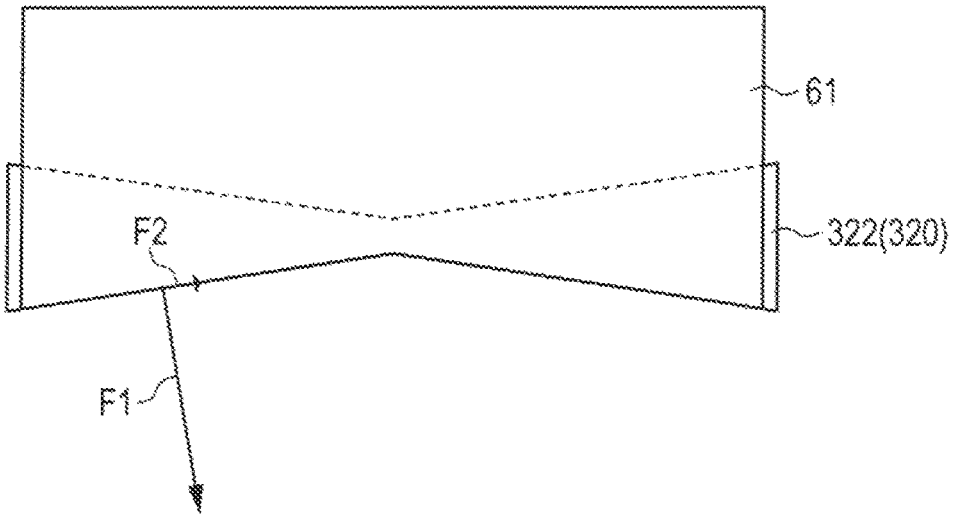
FIG. 7B illustrates a fixing belt wound on a reverse crown roller member having a relatively large amount of reverse crown.

As illustrated in FIGS. 7A and 7B, tension is imparted to fixing belt 61 in the parts wound on reverse crown roller members 321 and 322 (i.e., the inclined parts relative to the horizontal direction), and thus first force F1 perpendicular to the wound parts is exerted. This generates second force F2, which is stress of first force F1 and the conveying direction of fixing belt 61 (illustrated as the vertical direction). Since the direction of first force F1 is a direction toward the central portion from the both end portions in the axial direction, the direction of second force F2 is a direction to displace fixing belt 61 toward the central portion. A larger amount of reverse crown leads to a larger inclination angle of first force F1 relative to the vertical direction, and thus larger second force F2 results. Accordingly, as the amount of reverse crown of reverse crown roller member 320 becomes larger, belt wrinkles of fixing belt 61 arise more readily.

Figure 8:
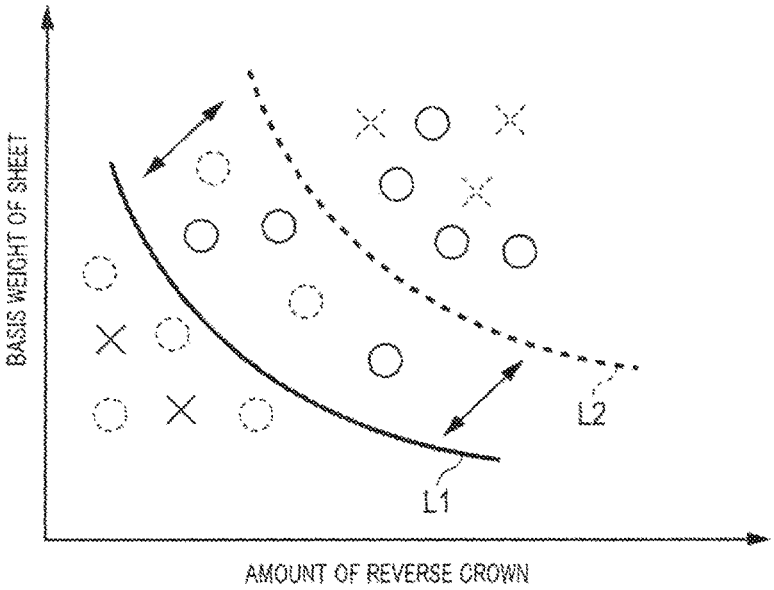
FIG. 8 is a graph showing a distribution of the quality of a sheet in terms of wavy wrinkles and the quality of a fixing belt in terms of belt wrinkles, from the standpoint of the amount of reverse crown of a reverse crown roller member and the basis weight of a sheet.

FIG. 8 is a graph showing a distribution of the quality of sheet S in terms of wavy wrinkles and the quality of fixing belt 61 in terms of belt wrinkles, from the standpoint of the amount of reverse crown of reverse crown roller member 320 and the basis weight of a sheet. In FIG. 8, "the circles" indicate where no wavy wrinkles of sheet S or no belt wrinkles of fixing belt 61 arise. Moreover, in FIG. 8, "the crosses" indicate where wavy wrinkles of sheets or belt wrinkles of fixing belt 61 arise. Further, in FIG. 8, "the circles" and "the crosses" in solid lines represent the quality of sheet S in terms of wavy wrinkles, whereas "the circles" and "the crosses" in broken lines represent the quality of fixing belt 61 in terms of belt wrinkles.

FIG. 8 shows confirmed experimental results of the quality of sheet S in terms of wavy wrinkles and the quality of fixing belt 61 in terms of belt wrinkles, from the standpoint of the amount of reverse crown of reverse crown roller member 320 and the basis weight of sheet S.

As shown in FIG. 8, it is confirmed that a larger amount of reverse crown of reverse crown roller member 320 results in better quality of sheet S in terms of wavy wrinkles, whereas a larger basis weight of sheet S results in poorer quality of fixing belt 61 in terms of belt wrinkles. Belt wrinkles of fixing belt 61 arise readily in a graph region with a large basis weight of a sheet.

Also, it is confirmed that a smaller amount of reverse crown of reverse crown roller member 320 results in better quality of fixing belt 61 in terms of belt wrinkles, whereas a smaller basis weight of sheet S results in poorer quality of sheet S in terms of wavy wrinkles. Wavy wrinkles of sheet S arise readily in a graph region with a small basis weight of sheet S.

In summary, positioning in the upper-side region of solid line L1 achieves good quality of sheet S in terms of wavy wrinkles, whereas positioning in the lower-side region of broken line L2 achieves good quality of fixing belt 61 in terms of belt wrinkles. In other words, tensioning section 200 that can adjust tension of fixing belt 61 to the range between solid line L1 and broken line L2 is desirable to achieve both good quality of sheet S in terms of wavy wrinkles and good quality of fixing belt 61 in terms of belt wrinkles.

Therefore, in the embodiment, under the control of control section 100, the shape in the axial direction of fixing belt 61 is changed so that the amount of reverse crown of tensioning section 200 varies in accordance with a type of sheet S which passes through fixing nip N. By changing the shape in the axial direction of fixing belt 61 in accordance with the type of sheet S and adjusting tension of fixing belt 61 to the range between solid line L1 and broken line L2 in FIG. 8, both good quality of sheet S in terms of wavy wrinkles and good quality of fixing belt 61 in terms of belt wrinkles can be achieved.

Meanwhile, the amount of reverse crown of tensioning section 200 herein refers to an absolute difference value in a distance between the position of the both end portions in the axial direction of tensioning section 200 and the position of the central portion in the axial direction.

Figure 9A:
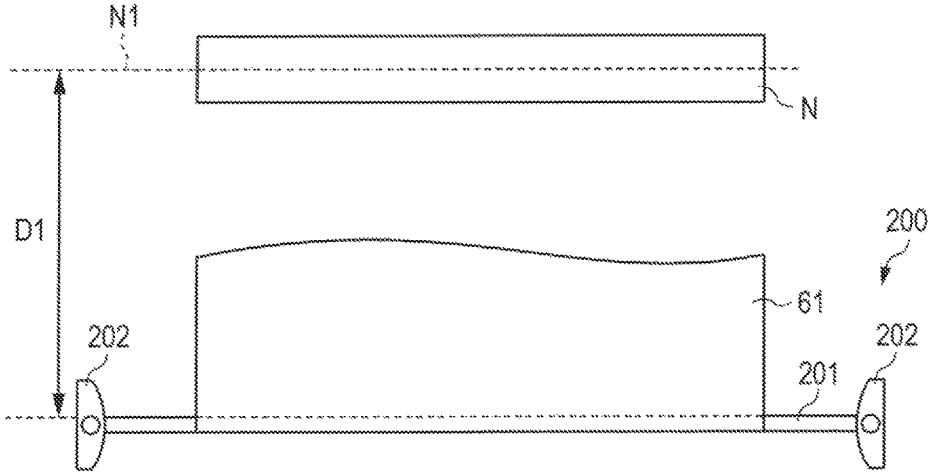
FIG. 9A illustrates a positional relationship between a tensioning section and a fixing nip when the shape of a contact portion is unchanged.
Figure 9B:
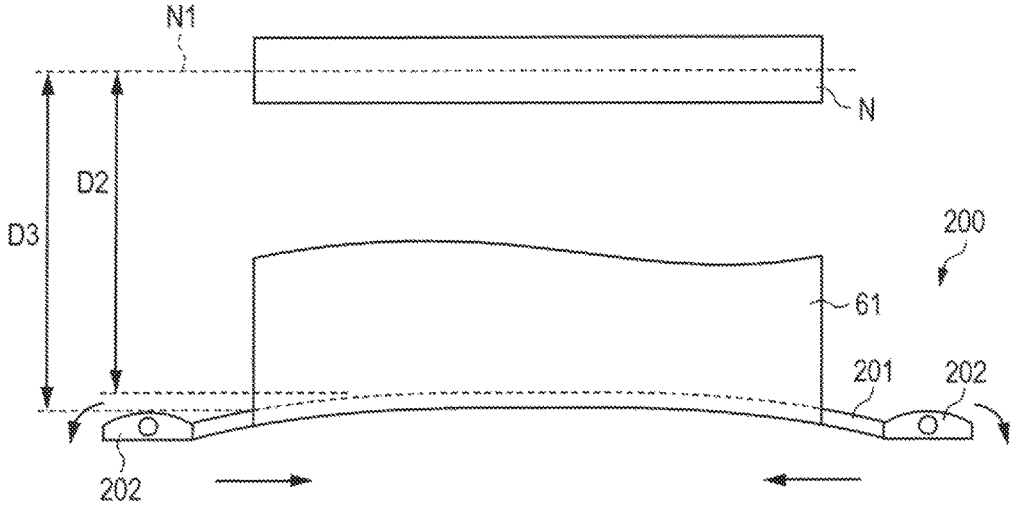
FIG. 9B illustrates a positional relationship between a tensioning section and a fixing nip when the shape of a contact portion is changed.

FIG. 9A illustrates a positional relationship between tensioning section 200 and fixing nip N when the shape of contact portion 201 is unchanged, whereas FIG. 9B illustrates a positional relationship between tensioning section 200 and fixing nip N when the shape of contact portion 201 is changed.

As illustrated in FIG. 9A, tensioning section 200 includes contact portion 201 and cams 202. Contact portion 201 is a portion which comes into contact with the inner surface of fixing belt 61 when fixing belt 61 is wound on. Contact portion 201 is a member with elastic force, such as silicone rubber, and extends longer than the width of fixing belt 61 in the axial direction.

Cams 202 are sheet-like members having turning axes at the centers and extending in predetermined directions, and are each provided at the both end portions in the axial direction of contact portion 201. Cams 202 in a state of FIG. 9A are disposed parallel to the vertical direction and are in contact with end faces at the end parts of contact portion 201. Cams 202 turn around the turning axes to change the shape of contact portion 201. Specifically, when right-side cam 202 turns clockwise and left-side cam 202 turns counter-clockwise, contact portion 201 is changed into a convex shape (upward as illustrated) and finally becomes a state of FIG. 9B. In other words, contact portion 201 elastically deforms to be positioned on a side of fixing nip N as contact portion 201 extends from the both end portions toward the central portion in the axial direction.

By changing the shape of contact portion 201, the shape of fixing belt 61, which comes into contact with contact portion 201, that is, to which tension is imparted, is changed. Specifically, the shape of fixing belt 61 is changed so that the both end portions in the axial direction are further apart, relative to central portion in the axial direction, from center line N1 which passes through the center of fixing nip N in the conveying direction of sheet S (the vertical direction as illustrated).

Under the control of control section 100, the shape of contact portion 201 of tensioning section 200 is controlled in accordance with a type of sheet S. For example, when a type of sheet S is cardboard (e.g., basis weight of 158 gsm or more), the shape of contact portion 201 is unchanged and thus remains linear, in other words, the amount of reverse crown of tensioning section is zero. Accordingly, the shape of fixing belt 61 is unchanged, and a distance between center line N1 of fixing nip N and contact portion 201 over the whole axial direction becomes constant at D1. In the case of cardboard, which tends to cause belt wrinkles of fixing belt 61, this can effectively suppress belt wrinkles of fixing belt 61 since the shape of fixing belt 61 is unchanged.

In the embodiment, although the amount of reverse crown of tensioning section 200 is set to zero in the case of cardboard, the present invention is not limited to this. The amount of reverse crown may be appropriately set to a value other than zero, in accordance with apparatuses in which tensioning section 200 is employed.

When a type of sheet S is thin paper (e.g., basis weight of 105 gsm or less) other than cardboard, the shape of contact portion 201 is changed to a state of FIG. 9B by turning cams 202. In other words, the shape of fixing belt 61 is changed to a shape conforming to the shape of contact portion 201. This results in larger distance D3 between center line N1 of fixing nip N and the both end portions in the axial direction of contact portion 201 than distance D2 between center line N1 of fixing nip N and the central portion in the axial direction of contact portion 201. Accordingly, in the case of thin paper, which tends to cause wavy wrinkles of sheet S, wavy wrinkles of sheet S can be effectively suppressed by changing the shape of fixing belt 61.

Figure 10:
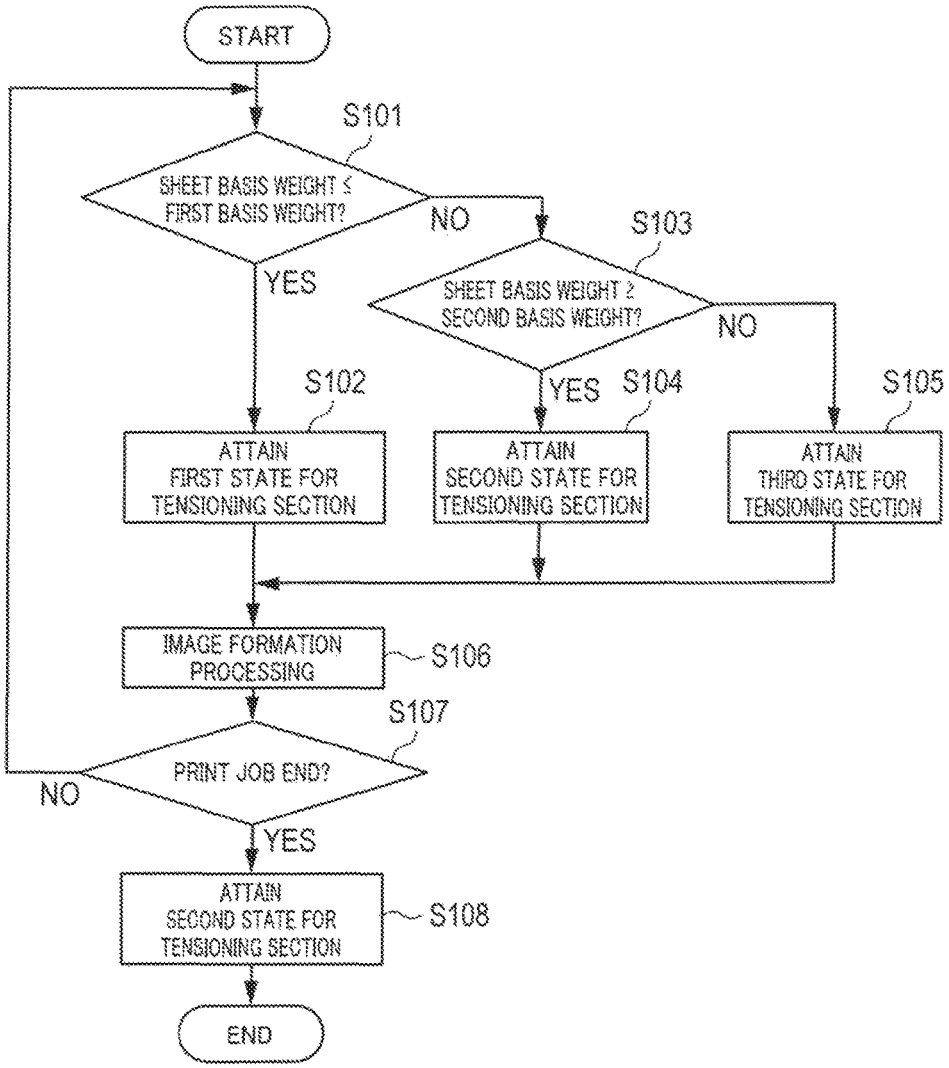
FIG. 10 is a flow chart showing one operation example when the control to change the shape of a fixing belt in an image forming apparatus is executed.

In the following, described will be an operation example when the control to change the shape of fixing belt 61 is executed, FIG. 10 is a flow chart showing an operation example when the control to change the shape of fixing belt 61 in image forming apparatus 1 is executed. The processing shown in FIG. 10 is executed when control section 100 receives an execution command for print job.

As shown in FIG. 10, control section 100 determines whether the basis weight of sheet S is a first basis weight (e.g., 105 gsm) or less (step S101). As a result of the determination, if the basis weight of sheet S is the first basis weight or less (step S101, YES), control section 100 performs the control to attain a first state in which tensioning section 200 is deformed as much as possible (step S102). The first state can be, for example, a state in which the difference between distance D3 and distance D2 in FIG. 9B is 0.8 mm.

If the basis weight of sheet S is larger than the first basis weight (step S101, NO), control section 100 determines whether the basis weight of sheet S is a second basis weight (e.g., 158 gsm) or more (step S103).

As a result of the determination, if the basis weight of sheet S is the second basis weight or more (step S103, YES), control section 100 performs the control to attain a second state in which the shape of tensioning section 200 is unchanged (step S104). In contrast, if the basis weight of sheet S is less than the second basis weight (step S103, NO), control section 100 performs the control to attain a third state for the shape of tensioning section 200 (step S105). The third state is a state in which the amount of deformation of tensioning section 200 is smaller than that in the first state, and can be, for example, a state in which the difference between distance D3 and distance D2 in FIG. 9B is 0.4 mm.

After steps S102, S104, and S105, control section 100 performs image formation processing (step S106). Then, control section 100 determines whether print job has ended or not (step S107). As a result of the determination, if print job has not yet ended (step S107, NO), the processing returns to step S101. If print job has ended (step S107, YES), control section 100 attains the second state for tensioning section 200 (step S108) and terminates the control.

According to the embodiment configured as above, the shape of fixing belt 61 is changed in accordance with a type of sheet S. For example, when sheet S is cardboard, the shape of fixing belt 61 is unchanged, that is, remains linear. As a result, force is evenly exerted on fixing belt 61 in the axial direction in the contact part between fixing belt 61 and sheet 5, and thus neither force to displace fixing belt 61 toward the center nor belt wrinkles of fixing belt 61 arise.

Meanwhile, when sheet S is thin paper, the shape of fixing belt 61 is changed so that the both end portions in the axial direction are further apart, relative to the central portion in the axial direction, from center line N1 which passes through the center of fixing nip N. This leads to a greater force exerted on sheet S in the central portion in the axial direction than in the both end portions, thereby generating a force to extend sheet S from the central portion to the both end portions. As a result, the generation of a force to displace sheet S toward the central portion can be suppressed, thereby preventing wavy wrinkles of sheet S from arising. As in the foregoing, the embodiment can suppress the occurrence of both wavy wrinkles of sheet S and belt wrinkles of fixing belt 61.

Moreover, since the amount of change in the shape of fixing belt 61 is determined in accordance with a type of sheet 5, an excessive change in the shape of fixing belt 61 can be suppressed.

Figure 11A:
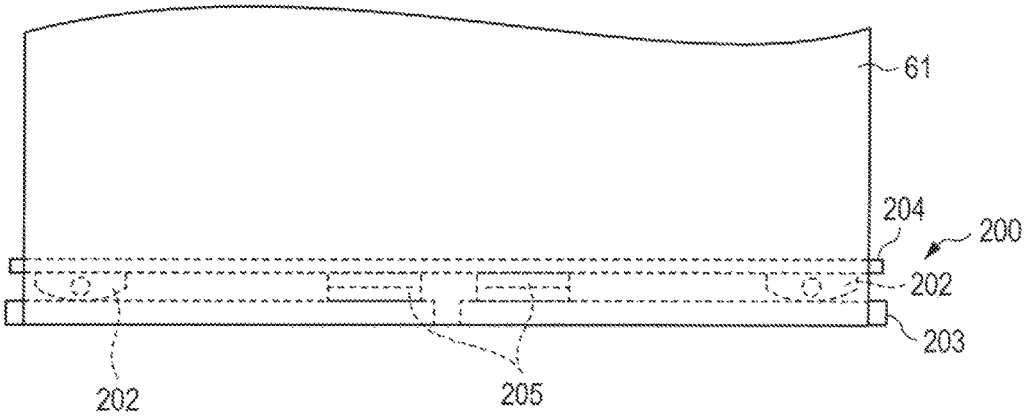
FIG. 11A illustrates a tensioning section according to Modification 1 in a state in which the shape of a fixing belt is unchanged.
Figure 11B:
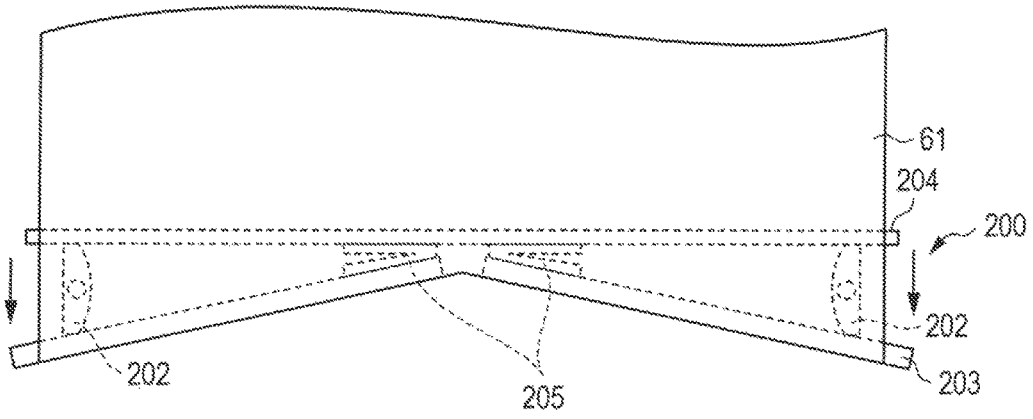
FIG. 11B illustrates a tensioning section according to Modification 1 in a state in which the shape of a fixing belt is changed.

Modification 1 will be described hereinafter. FIG. 11A illustrates tensioning section 200 according to Modification 1 in a state in which the shape of fixing belt 61 is unchanged, whereas FIG. 11B illustrates tensioning section 200 according to Modification 1 in a state in which the shape of fixing belt 61 is changed.

As illustrated in FIG. 11A, tensioning section 200 according to Modification 1 includes contact members 203, supporting member 204, and hinge section 205.

Two contact members 203 are in contact with the inner surface of fixing belt 61 and provided aligning in the both sides of the central portion in the axial direction of fixing belt 61. Contact members 203 extend from the central portion in the axial direction of fixing belt 61 toward a side of the end portions in the axial direction.

Supporting member 204 extends in the axial direction and provided in the whole axial direction of fixing belt 61. Supporting member 204 turnably supports contact members 203 via hinge section 205.

Hinge section 205 connects two contact members 203 with supporting member 204 at a position of the central portion in the axial direction of fixing belt 61. Further, cams 202 are provided between contact members 203 and both end portions in the axial direction of supporting member 204.

In a state of FIG. 11A, cams 202 are disposed in parallel to the axial direction and turned around the turning axes. By turning right-side cam 202 clockwise and turning left-side cam 202 counter-clockwise, contact members 203 turn with a position of hinge section 205 as a turning pivot, and thus are movable between the position of FIG. 11A in which the shape of fixing belt 61 is unchanged and the position of FIG. 11B in which the shape of fixing belt 61 is deformed as much as possible. In other words, contact members 203 are turned, under the control of control section 100 in accordance with a type of sheet S, so that the end portions in the axial direction are positioned on the side of fixing nip N, relative to the central portion in the axial direction.

The configuration like this can also suppress the occurrence of belt wrinkles of fixing belt 61 by changing fixing belt 61 to the shape like FIG. 11A when a type of sheet S is cardboard, and suppress the occurrence of wavy wrinkles of sheet S by changing fixing belt 61 to the shape like FIG. 11B when a type of sheet S is thin paper.

Figure 12A:
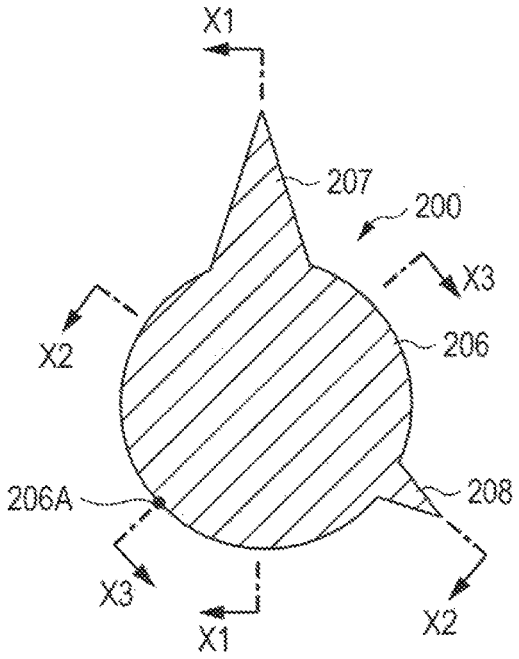
FIG. 12 A is a sectional view illustrating a tensioning section according to Modification 2.
FIG. 12B is a sectional view taken along line X1-X1 of the tensioning section illustrated in FIG. 12A.
FIG. 12C is a sectional view taken along line X2-X2 of the tensioning section illustrated in FIG. 12A.
FIG. 12D is a sectional view taken along line X3-X3 of the tensioning section illustrated in FIG. 12A.
Figure 12B:
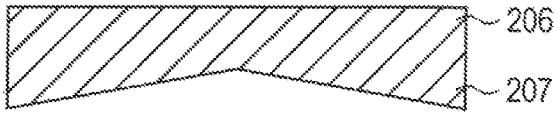

In the following, Modification 2 will be described. FIG. 12A is a sectional view illustrating tensioning section 200 according to Modification 2. FIG. 12B is a sectional view taken along line X1-X1 of tensioning section 200 illustrated in FIG. 12A, FIG. 12C is a sectional view taken along line X2-X2 of tensioning section 200 illustrated in FIG. 12A, and FIG. 12D is a sectional view taken along line X3-X3 of tensioning section 200 illustrated in FIG. 12A.

As illustrated in FIG. 12A, tensioning section 200 according to Modification 2 is disposed in a position contactable with the inner surface of fixing belt 61, and includes cylindrical body portion 206, first contact portion 207, and second contact portion 208.

First contact portion 207 protrudes from the peripheral surface of body portion 206. Second contact portion 208 protrudes from the peripheral surface of body portion 206 at a position different from first contact portion 207, and has a smaller amount of protrusion than first contact portion 207.

Figure 12C:
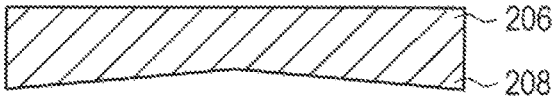
Figure 12D:
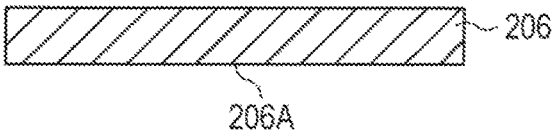

As illustrated in FIGS. 12B and 12C, first contact portion 207 and second contact portion 208 have shapes in which amounts of protrusion are larger toward the both end portions from the central portions in the axial direction, and come into contact with fixing belt 61 at the apex parts when facing the inner surface of fixing belt 61.

As illustrated in FIG. 12A, body portion 206 is also contactable with the inner surface of fixing belt 61 at a position of third contact portion 206A, which is a position different from the positions of first contact portion 207 and second contact portion 208. As illustrated in FIG. 12D, third contact portion 206A linearly extends in the axial direction and comes into contact with fixing belt 61 when facing the inner surface of fixing belt 61.

Tensioning section 200, under the control of control section 100, can switch contact positions with the inner surface of fixing belt 61, among the position of first contact portion 207, the position of second contact portion 208, and the position of third contact portion 206A.

As in the foregoing, the shape of fixing belt 61 can be changed by changing the contact position between body portion 206 of tensioning section 200 and fixing belt 61 in accordance with a type of sheet S. Accordingly, the occurrence of both wavy wrinkles of sheet S and belt wrinkles of fixing belt 61 can be suppressed.

Figure 13A:
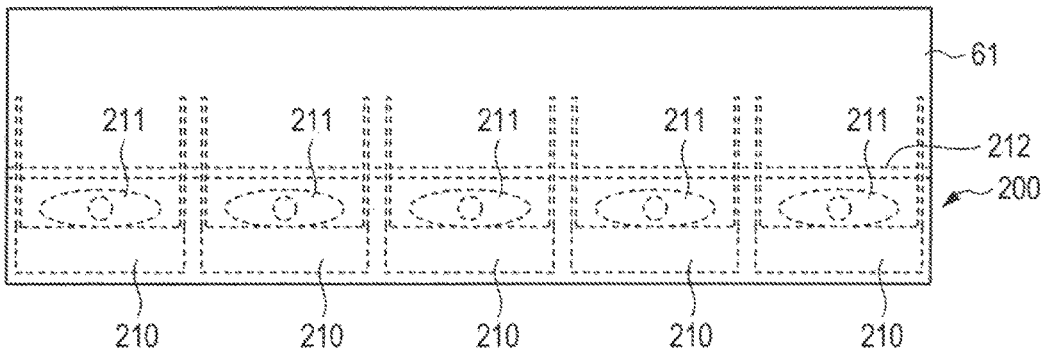
FIG. 13A illustrates a tensioning section according to Modification 3 in a state in which the shape of a fixing belt is unchanged.
Figure 13B:
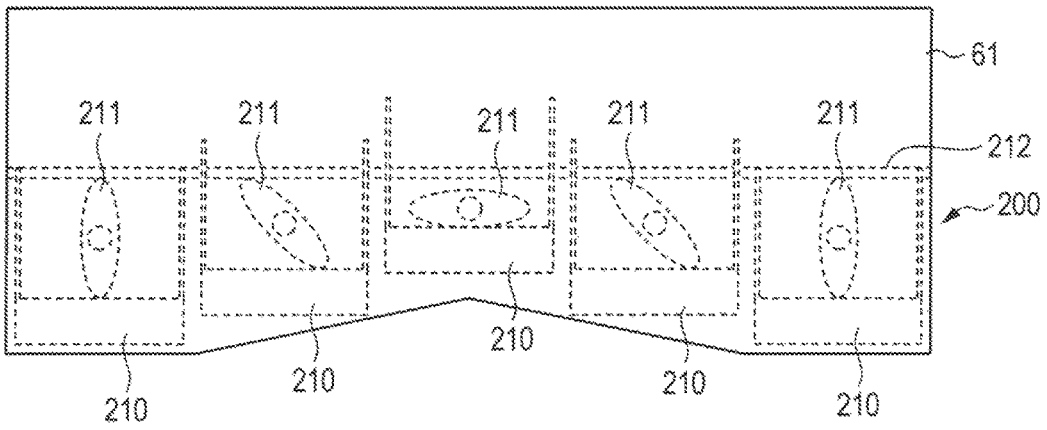
FIG. 13B illustrates a tensioning section according to Modification 3 in a state in which the shape of a fixing belt is changed.

In the following, Modification 3 will be described. FIG. 13A illustrates tensioning section 200 according to Modification 3 in a state in which the shape of fixing belt 61 is unchanged, whereas FIG. 13B illustrates tensioning section 200 according to Modification 3 in a state in which the shape of fixing belt 61 is changed.

As illustrated in FIG. 13A, tensioning section 200 according to Modification 3 includes roller members 210, cams 211, and base 212. FIGS. 13A and 13B illustrate sectional parts taken along planes parallel to the axial direction of roller members 210, showing the lower half parts from the rotational axes.

A plurality of or five (three or more) roller members 210 are provided aligning in the axial direction and supported movable relative to the rotational axes (not shown) in the vertical direction (as illustrated). Roller members 210, via the surface parts, are in contact with the inner surface of fixing belt 61.

Base 212 is provided in the whole axial direction of fixing belt 61 and extends through the inside of each roller member 210.

Cams 211 are provided rotatably between base 212 and the inner surface of each roller member 210. When cam 211 rotates, one end portion of cam 211 comes into contact with base 212 and the other end portion of cam 211 comes into contact with the inner surface of roller member 210. As illustrated in FIG. 13B, the other end portion of cam 211 comes into contact with the inner surface of roller member 210 and presses roller member 210, thereby shifting roller member 210 downward. In other words, roller members 210 are configured to be movable such that the contact position with fixing belt 61 and the distance to the fixing nip are changed.

This can change the positions in the vertical direction of roller members 210. Under the control of control section 100, the shape of fixing belt 61 can be changed so that roller members 210 (positioned at positions corresponding to the central portion in the axial direction of fixing belt 61) are positioned on a side of fixing nip N, that is, in the upper side (as illustrated), relative to roller members 210 (positioned at positions corresponding to the both end portions in the axial direction). Accordingly, the occurrence of both wavy wrinkles of sheet S and belt wrinkles of fixing belt 61 can be suppressed.

Although the number of roller members 210 is five in Modification 3, the present invention is not limited to this. The number of roller members 210 may be, for example, three or four.

Figure 14A:
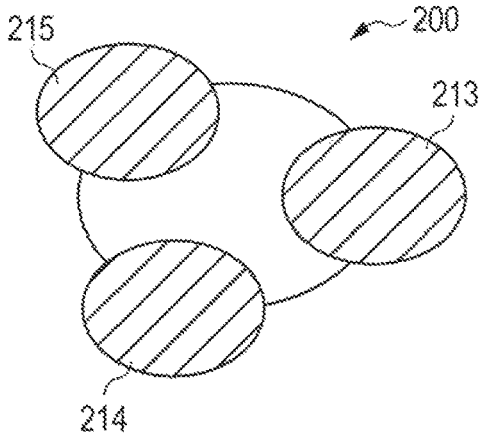
FIG. 14A is a sectional view illustrating a tensioning section according to Modification 4.
Figure 14B:
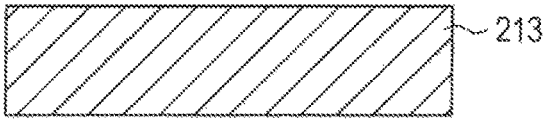
FIG. 14B is a sectional view illustrating a first roller.
Figure 14C:
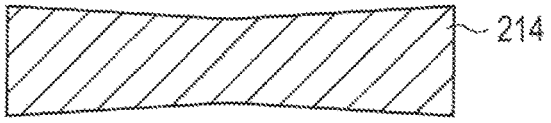
FIG. 14C is a sectional view illustrating a second roller.
Figure 14D:
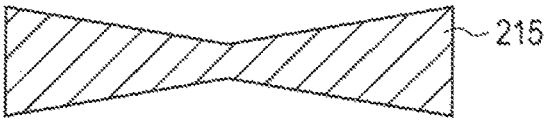
FIG. 14D is a sectional view illustrating a third roller.

In the following, Modification 4 will be described. FIG. 14A is a sectional view illustrating tensioning section 200 according to Modification 4. FIG. 14B is a sectional view illustrating first roller 213, FIG. 14C is a sectional view illustrating second roller 214, and FIG. 14D is a sectional view illustrating third roller 215.

As illustrated in FIG. 14A, tensioning section 200 according to Modification 4 includes first roller 213, second roller 214, and third roller 215.

As illustrated in FIG. 14B, first roller 213 linearly extends in the axial direction. As illustrated in FIG. 14C and FIG. 14D, second roller 214 and third roller 215 have shapes with a larger diameter toward the both end portions from the central portion in the axial direction. As illustrated in FIG. 14D, third roller 215 has a larger absolute difference value between the diameter in the central portion in the axial direction and the diameter in the end portions in the axial direction than that of second roller 214.

First roller 213, second roller 214, and third roller 215 are contactable with the inner surface of fixing belt 61, and tensioning section 200 is controlled, under the control of control section 100, so that any of first roller 213, second roller 214, and third roller 215 comes into contact with fixing belt 61. By switching the contact part of tensioning section 200 with fixing belt 61, among first roller 213, second roller 214, and third roller 215, the amount of deformation of fixing belt 61 can appropriately be controlled. As a result, the occurrence of both wavy wrinkles of sheet S and belt wrinkles of fixing belt 61 can be suppressed.

Figure 15A:
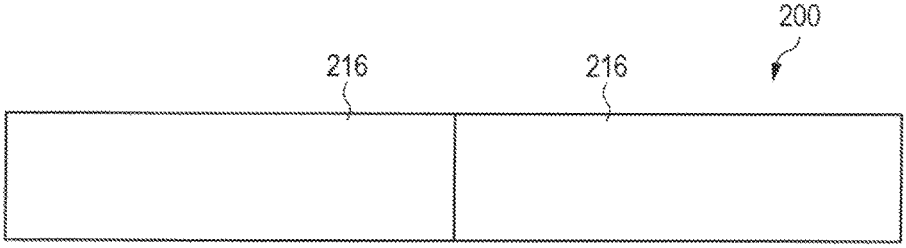
FIG. 15A illustrates a tensioning section according to Modification 5 in a state in which the shape of a fixing belt is unchanged.
Figure 15B:
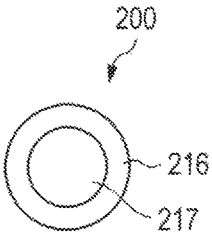
FIG. 15B is a tensioning section according to Modification 5 viewed from the axial direction.
Figure 15C:
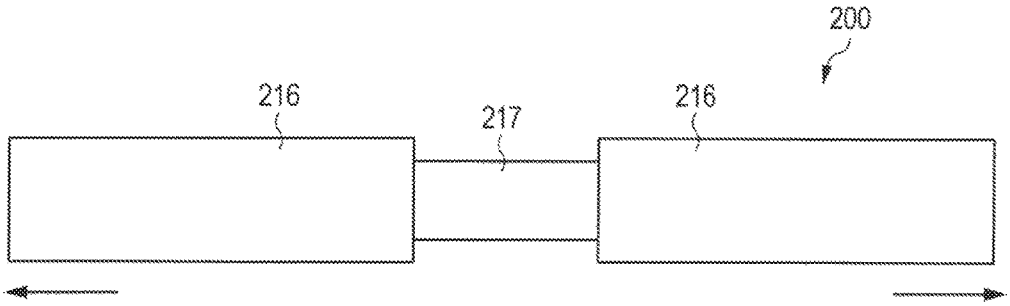
FIG. 15C illustrates a tensioning section according to Modification 5 in a state in which the shape of a fixing belt is changed.

In the following, Modification 5 will be described. FIG. 15A illustrates tensioning section 200 according to Modification 5 in a state in which the shape of fixing belt 61 is unchanged. FIG. 15B is tensioning section 200 according to Modification 5 viewed from the axial direction. FIG. 15C illustrates tensioning section 200 according to Modification 5 in a state in which the shape of fixing belt 61 is changed.

As illustrated in FIGS. 15A and 15B, tensioning section 200 according to Modification 5 includes large-diameter rollers 216 and small-diameter roller 217.

Large-diameter rollers 216 are each configured in a hollow cylindrical shape with a larger outer diameter than cylindrically formed small-diameter roller 217, and configured to be capable of covering small-diameter roller 217. A pair of large-diameter rollers 216 is provided aligning in the axial direction and movable in the axial direction.

Small-diameter roller 217 can come into contact with fixing belt 61 by moving each large-diameter roller 216 outward in the axial direction. Tensioning section 200, under the control of control section 100, can control the amount of deformation of fixing belt 61 by controlling the amount of movement of each large-diameter roller 216 in the axial direction. As a result, the occurrence of both wavy wrinkles of sheet S and belt wrinkles of fixing belt 61 can be suppressed.

Figure 16A:
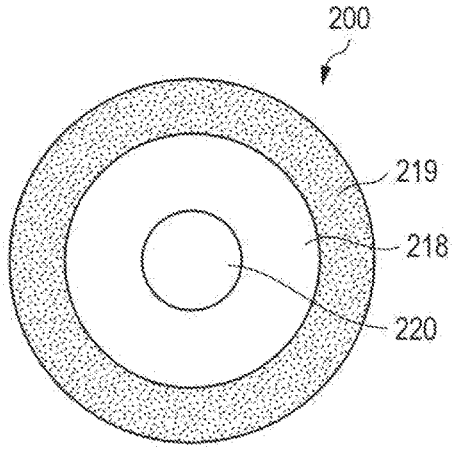
FIG. 16A is a tensioning section according to Modification 6 viewed from the axial direction.
Figure 16B:
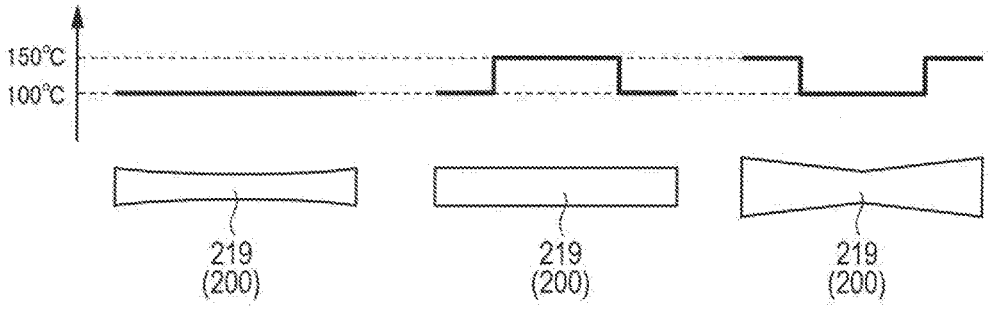
FIG. 16B illustrates changes in the shapes of tensioning sections according to the temperature distribution in the axial direction of the tensioning sections.

In the following, Modification 6 will be described. FIG. 16A is tensioning section 200 according to Modification 6 viewed from the axial direction. FIG. 16B illustrates changes in the shapes of tensioning sections 200 according to the temperature distribution in the axial direction of tensioning section 200.

As illustrated in FIG. 16A, tensioning section 200 according to Modification 6 includes metal roller 218, elastic section 219, and heating section 220.

Metal roller 218 is configured in a hollow cylindrical shape, and the outer peripheral surface is covered with elastic section 219. Elastic section 219 is composed of materials, such as silicone rubber, and configured to become thicker toward sides of the both end portions from the central portion in the axial direction, as illustrated in FIG. 16B. Elastic section 219 has the thickness at the end portion in the axial direction of 2 mm.

Heating section 220 is disposed inside metal roller 218, and can control the temperature in the axial direction of tensioning section 200 under the control of control section 100. When heating section 220 controls the temperature, the shape of tensioning section 200 is changed by thermal expansion of elastic section 219. For example, when the temperature in the whole axial direction of tensioning section 200 is set constant at 100° C., since the degree of thermal expansion of elastic section 219 is constant in the axial direction, tensioning section 200 is changed from a state without temperature control by thermal expansion of elastic section 219.

When the temperature of tensioning section 200 is set to 100° C. in the both end portions in the axial direction and to 150° C. in the central portion in the axial direction, tensioning section 200 becomes linear since the amount of expansion due to thermal expansion in the central portion in the axial direction of elastic section 219 is larger than in the both end portions in the axial direction. Meanwhile, when the temperature of tensioning section 200 is set to 150° C. in the both end portions in the axial direction and to 100° C. in the central portion in the axial direction, the amount of expansion due to thermal expansion in the both end portions in the axial direction of elastic section 219 is larger than in the central portion in the axial direction. This changes tensioning section 200 to a shape thicker in the both end portions, compared with the original shape.

The configuration like this can also change the shape of fixing belt 61 by performing temperature control by heating section 220. As a result, the occurrence of both wavy wrinkles of sheet S and belt wrinkles of fixing belt 61 can be suppressed.

The aforementioned embodiments merely describe examples of embodiments for practicing the present invention, and should not be construed as limiting the technical scope of the present invention in any way. Variations are possible without departing from the spirit or scope of the present invention.

The present invention is applicable to an image forming system composed of a plurality of units including an image forming apparatus. A plurality of units include an external apparatus, such as a post-processing apparatus or a control apparatus connected through a network.

What is claimed is:

1. A fixing device comprising:

a first pressing member;

a rotatable endless fixing belt which is wound on the first pressing member;

a second pressing member configured to press the first pressing member via the fixing belt and to form a fixing nip between the second pressing member and the fixing belt;

a tensioning section on which the fixing belt is wound on an upstream side relative to the fixing nip in a rotation direction of the fixing belt, and which is configured to impart tension to the fixing belt; and a control section configured to control the tensioning section such that a shape in an axial direction of the fixing belt is changed in accordance with a type of a sheet which passes through the fixing nip.

2. The fixing device according to claim 1, wherein the control section changes the shape in the axial direction of the fixing belt such that an amount of reverse crown of the tensioning section varies.

3. The fixing device according to claim 1, wherein the control section changes the shape in the axial direction of the fixing belt such that both end portions in the axial direction are further apart, relative to a central portion in the axial direction, from a center line which passes through a center of the fixing nip in a conveying direction of the sheet.

4. The fixing device according to claim 3, wherein:

the tensioning section includes an elastically deformable contact portion which extends in the axial direction and which comes into contact with the fixing belt; and the control section performs a control action, in accordance with the type of the sheet, such that the contact portion is elastically deformed so as to be positioned on a side of the fixing nip as the contact portion extends from both end portions toward a central portion in the axial direction.

5. The fixing device according to claim 3, wherein:

the tensioning section includes two contact members which are provided aligning in both sides of the central portion in the axial direction of the fixing belt and which extend toward a side of the end portions in the axial direction from the central portion in the axial direction of the fixing belt, and a supporting member configured to turnably support the contact members with a central portion in the axial direction as a pivot; and the control section performs a control action, in accordance with the type of the sheet, such that the contact members are turned so that the central portion in the axial direction of the contact members is positioned on a side of the fixing nip, relative to the both end portions in the axial direction.

6. The fixing device according to claim 3, wherein:

the tensioning section includes a rotatable cylindrical body portion which extends in the axial direction, a first contact portion which protrudes from the body portion and has a larger amount of protrusion toward the both end portions in the axial direction from the central portion in the axial direction, and a second contact portion which protrudes from the body portion at a position different from the first contact portion, which has a larger amount of protrusion toward the both end portions in the axial direction from the central portion in the axial direction, and which has a smaller amount of protrusion than that in the axial direction of the first contact portion;

the tensioning section is contactable with the fixing belt via any of the first contact portion, the second contact portion, and the body portion at a position different from the first contact portion and the second contact portion; and the control section controls, in accordance with the type of the sheet, the tensioning section such that any of the first contact portion, the second contact portion, and the body portion at a position different from the first contact portion and the second contact portion comes into contact with the fixing belt.

7. The fixing device according to claim 3, wherein:

the tensioning section includes at least three roller members which are provided aligning in the axial direction and which come into contact with the fixing belt;

the roller members are configured to be movable such that a contact position with the fixing belt and a distance to the fixing nip are changed; and the control section controls, in accordance with the type of the sheet, the tensioning section such that the roller member which is positioned at a position corresponding to the central portion in the axial direction of the fixing belt is positioned on a side of the fixing nip, relative to the roller members which are positioned at positions corresponding to the both end portions in the axial direction.

8. The fixing device according to claim 3, wherein:

the tensioning section includes a first roller which linearly extends in the axial direction, a second roller having a larger diameter toward a central portion from both end portions in the axial direction, and a third roller having a larger diameter toward a central portion from both end portions in the axial direction, and having a larger absolute difference value between a diameter of the central portion in the axial direction and a diameter of the both end portions in the axial direction than that of the second roller; and the control section controls, in accordance with the type of the sheet, the tensioning section such that any of the first roller, the second roller, and the third roller comes into contact with the fixing belt.

9. The fixing device according to claim 3, wherein:

the tensioning section includes a cylindrical small-diameter roller, and a pair of large-diameter rollers which are configured in a hollow cylindrical shape to be capable of covering the small-diameter roller, and are movable in the axial direction; and the control section controls, in accordance with the type of the sheet, changing of an amount of movement in the axial direction of the large-diameter rollers.

10. The fixing device according to claim 3, wherein:

the tensioning section includes a hollow cylindrical metal roller, an elastic section which covers the metal roller, and a heating section disposed inside the metal roller; and the control section controls, in accordance with the type of the sheet, the heating section such that a temperature in the axial direction of the heating section is changed.

11. The fixing device according to claim 10, wherein a thickness of the elastic section is larger in both end portions in the axial direction than in a central portion in the axial direction.

12. The fixing device according to claim 1, wherein the tensioning section contacts and imparts tension to an inner circumferential surface of the fixing belt.

13. An image forming apparatus comprising:

a first pressing member;

a rotatable endless fixing belt which is wound on the first pressing member;

a second pressing member configured to press the first pressing member via the fixing belt and to form a fixing nip between the second pressing member and the fixing belt;

a tensioning section on which the fixing belt is wound on an upstream side relative to the fixing nip in a rotation direction of the fixing belt, and which is configured to impart tension to the fixing belt; and a control section configured to control the tensioning section such that a shape in an axial direction of the fixing belt is changed in accordance with a type of a sheet which passes through the fixing nip.

14. The image forming apparatus according to claim 13, wherein the tensioning section contacts and imparts tension to an inner circumferential surface of the fixing belt.

15. A belt-shape changing method in a fixing device which includes a first pressing member, a rotatable endless fixing belt wound on the first pressing member, a second pressing member configured to press the first pressing member via the fixing belt and to form a fixing nip between the second pressing member and the fixing belt, and a tensioning section on which the fixing belt is wound on an upstream side relative to the fixing nip in a rotation direction of the fixing belt and which is configured to impart tension to the fixing belt, the method comprising:

controlling the tensioning section such that a shape in an axial direction of the fixing belt is changed in accordance with a type of a sheet which passes through the fixing nip.

16. The belt-shape changing method according to claim 15, wherein the tensioning section contacts and imparts tension to an inner circumferential surface of the fixing belt.

* * * * *